United States Patent [19]

McVey

[11] 4,034,252

[45] July 5, 1977

[54] CERAMIC LAMP SEAL AND CONTROL OF SEALING FRIT DISTRIBUTION

[75] Inventor: Charles I. McVey, Shaker Heights, Ohio

[73] Assignee: General Electric Company, Schenectady, N.Y.

[22] Filed: Dec. 15, 1975

[21] Appl. No.: 640,804

[52] U.S. Cl. ..... 313/217; 313/220; 174/50.61

[51] Int. Cl.[2] ..... H01J 17/04; H01J 17/16

[58] Field of Search ..... 313/217, 219, 220, 221, 313/253, 317; 228/204, 258; 174/50.58, 50.61

[56] References Cited

UNITED STATES PATENTS

| | | | |
|---|---|---|---|
| 3,363,133 | 1/1968 | Harris et al. | 313/217 |
| 3,609,437 | 9/1971 | Tol | 313/220 |
| 3,882,346 | 5/1973 | McVey | 313/253 |
| 3,886,392 | 5/1975 | Barakitis et al. | 313/220 |

*Primary Examiner*—Rudolph V. Rolinec
*Assistant Examiner*—Vincent J. Sunderdick
*Attorney, Agent, or Firm*—Ernest W. Legree; Lawrence R. Kempton; Frank L. Neuhauser

[57] ABSTRACT

A metal vapor arc lamp comprises an alumina ceramic arc tube having an end closed by an apertured ceramic plug sealed by sealing frit. A metal lead wire extending through the aperture is also sealed therein by sealing frit and supports an electrode within the arc tube. A cross wire attached to the inlead immediately above the plug forms a wick equalizing the distribution of sealing frit between the plug seal and the inlead seal and also serves as a hanger for supporting the plug and electrode assembly in the arc tube during sealing.

6 Claims, 4 Drawing Figures

CERAMIC LAMP SEAL AND CONTROL OF SEALING FRIT DISTRIBUTION

The invention relates generally to arc discharge lamps utilizing alumina ceramic envelopes, and more particularly to their end and inlead seal structures.

BACKGROUND OF THE INVENTION

Alumina ceramic envelopes are of particular interest in connection with high pressure sodium vapor lamps which are now widely used for outdoor lighting applications on account of their high efficacy, generally in excess of 100 lumens per watt. Alumina ceramic is resistant to sodium at high temperatures and both high density polycrystalline alumina and monocrystalline alumina or synthetic sapphire are utilized for lamp envelopes. The lamp fill comprises sodium along with a rare gas to facilitate starting, and mercury for improved efficiency. The ends of the alumina tube are sealed by suitable closure members affording connection to thermionic electrodes. The ceramic arc tube is generally supported within an outer vitreous envelope or jacket provided at one end with a mogul screw base. The electrodes of the arc tube are connected to the terminals of the base, that is to shell and center contact, and the inter-envelope space is usually evacuated in order to conserve heat.

One design of end seal for an alumina ceramic arc tube which is described in U.S. Pat. No. 3,882,346 - McVey, utilizes an alumina ceramic plug sealed in the end of the arc tube and having a central perforation through which is sealed a lead wire of ceramic-matching metal, that is, of metal which approximately matches the coefficient of expansion of the ceramic, perferably niobium or alternatively tantalum in the present case where ceramic is polycrystalline alumina. The sealing is effected through a glassy sealing composition which melts when the assembly is suitably heated and forms the ceramic-to-ceramic and ceramic-to-metal seal.

At sealing, the assembly is heated until the sealing composition or frit is molten and is drawn by capillary action into the ring-like gap between arc tube and ceramic plug and into the inlead hole through the plug. A problem which has been encountered with this seal design is unevenness in the distribution of sealing frit as between the peripheral seal of arc tube to plug and the central seal of plug to inlead which may cause weak seals and leakers. The object of the invention is to remedy this problem.

SUMMARY OF THE INVENTION

A wire crosspiece attached to the inlead above the ceramic plug has been used as a hanger to support the inlead, electrode and plug assembly in the end of the arc tube during sealing. In accordance with the invention, the crosspiece is disposed close to the surface of the plug and serves as a wick for feeding molten sealing frit by capillary action to the seals. The crosspiece permits the distribution of sealing frit to be equalized as between the ring seal of arc tube to plug and the inlead aperture seal to that more uniform seals of greater reliability are achieved.

DETAILED DESCRIPTION

Figure 1:
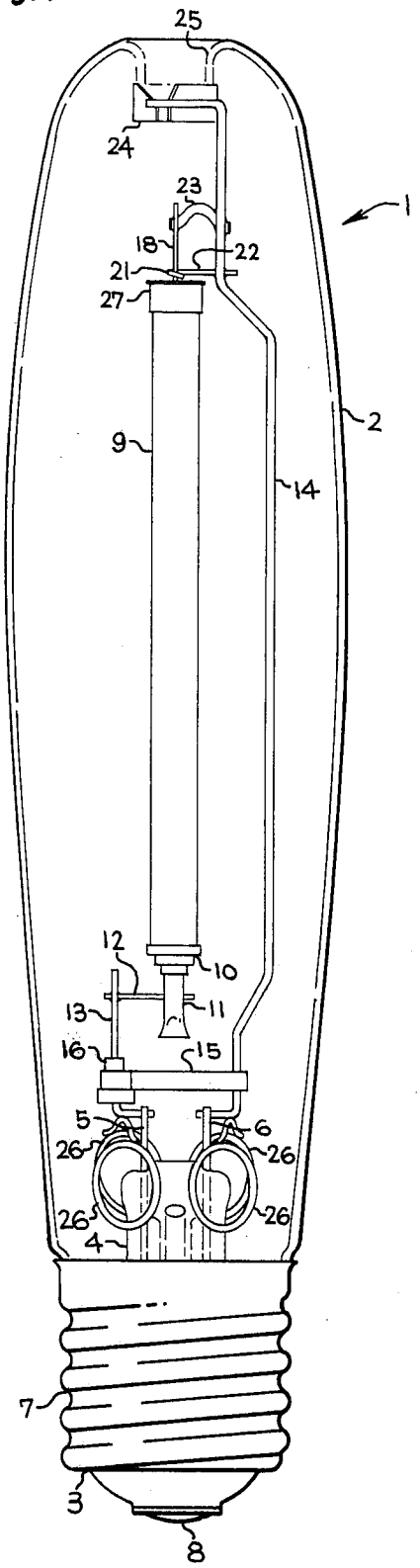
FIG. 1 is a side elevation view of a ceramic arc tube lamp embodying the present invention.

A high pressure sodium vapor lamp 1 embodying the invention in preferred form and corresponding to a 400-watt size is illustrated in FIG. 1. It comprises a vitreous outer envelope 2 with a standard mogul screw base 3 attached to one end and comprising a re-entrant stem press 4 through which extend, in conventional fashion, a pair of relatively heavy lead-in conductors 5,6 whose outer ends are connected to the screw shell 7 and eyelet 8 of the base.

The arc tube 9 centrally located within the outer envelope comprises a piece of crystalline alumina tubing having its lower end closed by a metal end cap 10, suitably of niobium which matches the expansion coefficient of alumina ceramic. A metal tube 11 which may also be of niobium is hermetically sealed through the cap and serves as an exhaust and fill tubulation during manufacture of the lamp. The exhaust tube is sealed off at its outer end and serves as a reservoir in which excess sodium-mercury-amalgam condenses during operation of the lamp. The lower electrode within the lamp is attached to the inward projection of tube 11. A short wire connector 12 is welded to tube 11 and to short support rod 13 which in turn is welded to lead-in conductor 5. Support rod 13 is braced to single side rod 14 welded to lead-in conductor 6, by means of a strap 15 attached to the side rod and wrapping around an insulator 16 threaded over support rod 13.

Figure 2:
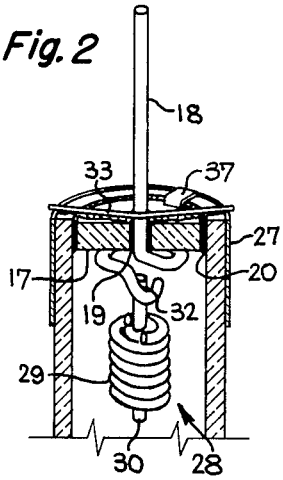
FIG. 2 is a fragmentary pictorial view of the sectioned upper end of the arc tube.

The upper end of the arc tube is sealed by a perforated alumina ceramic plug 17 best seen in FIG. 2. As illustrated, the plug is centrally perforated and a niobium inlead wire 18 extending through the hole is hermetically sealed by sealing composition indicated at 19. The plug in turn is hermetically sealed into the end of arc tube 9 by a ring of sealing composition indicated at 20. The inlead supports the upper electrode within the arc tube, and its external portion passes through a loop 21 in transverse support wire 22 attached to side rod 14. This arrangement allows for thermal elongation of the arc tube during operation, and a resilient metal ribbon 23 assures a good electrical connection. The upper end of side rod 14 is braced by spring clamp 24 which engages inverted nipple 25 in the dome end of the outer envelope. The outer envelope or jacket is evacuated by pumping and flashing getter rings 26. A metal reflector band 27 may be desirable around the upper end of the arc tube in order to maintain the desired temperature, particularly in smaller sizes of lamps, for instance 250 watts or less.

The illustrated lamp is intended for base down operation and has the amalgam reservoir 11 lowermost. In a similar design for base up operation, the arc tube is reversed end for relative to the outer envelope in order to have the amalgam reservoir lowermost, and the attachments or supports for the arc tube including the expansion flip loop 21 are reversed appropriately.

The hermetic seals, including that of the inlead wire through the ceramic plug and that of the plug to the arc tube may be made using various sealing compositions, sometimes referred to as sealing glass, which comprise primarily aluminum oxide and calcium oxide. One composition which we have used successfully is designated G-54 and consists of approximately 54.0% $Al_2O_3$, 38.5% CaO, and 7.5% MgO by weight. Other compositions which may be used are those described in U.S. Pat. Nos. 3,281,309 — Ross, 3,441,421 — Sarver et al., and 3,588,577 — McVey.

The lamp utilizes self-heating thermionic electrodes 28 best seen in FIG. 2. The electrode comprises two helical layers 29 of tungsten wire around a tungsten shank 30. The inner helical layer has spaced turns and electron emitting material such as dibarium calcium tungstate $Ba_2CaWO_6$ is enclosed in the interstices between turns. The inner end of inlead 18 is bent sharply to a radial direction immediately beyond the hole through plug 17 and then curves into a ring-like loop 31 which terminates in an inwardly and downwardly directed extension to which the shank 30 of the electrode is welded at 32. The feature of loop 31 which provides thermal isolation between the electrode and the inlead seal and also serves as a platform to support ceramic plug 17 prior to sealing is more fully described and is claimed in the copending application of Charles I. McVey and Robert L. Kelling, filed of even data herewith, entitled "Ceramic Envelope Plug and Lead Wire End Seal" and similarly assigned.

Figure 3:
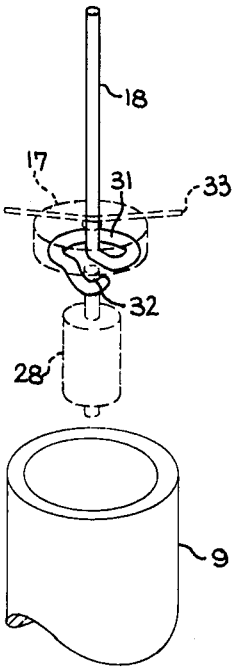
FIG. 3 shows the ceramic plug, lead, and electrode assembly ready to be lowered into the arc tube end for sealing.

The inlead, electrode and ceramic plug assembly prior to sealing is best seen in FIG. 3 wherein the plug and electrode are shown in phantom. A light wire crosspiece 33 is spot welded to inlead 18 just above plug 17 and serves to support the assembly when it is lowered into the open end of arc tube 9. The crosspiece is bent or arched slightly about its midpoint in a horizontal plane transverse to said inlead in order to have its ends engage the edges of the arc tube on a diameter whereby the assembly will hang vertically in the tube. A measured quantity of sealing composition or glass frit is placed on the ceramic plug, suitably as a slurry, and the closure assembly is then heated to the melting temperature of the glass frit. The molten frit is drawn by capillary action into the ring-like crevice between arc tube and plug and that between plug and inlead and the seals form upon cooling. This process advantageously favors degassing of the frit.

Prior to the invention, it would happen occasionally that the frit would collect at the peripheral seal of arc tube to plug and the quantity at the central seal of the inlead would be insufficient, or vice versa. However, in accordance with the invention, crosspiece 33 is disposed close to the surface or ceramic plug 17 in order to serve as a wick for feeding molten sealing frit by capillary action during the sealing operation. The surface tension of the molten frit causes it to form a thin wedge of liquid between the upper surface of the ceramic disk and the underside of the crosspiece as illustrated in FIG. 2. This permits molten frit to flow in either direction and the distribution of sealing frit between the peripheral seal of plug to arc tube and the central seal of inlead to plug, is thereby equalized. As a result, more uniform seals of greater reliability are achieved. As shown in FIG. 2 of the drawing, a ridge of sealing frit remains on the surface of the plug reaching up to the crosspiece and extending from the inlead-plug seal to the plug-envelope seal on each side.

Figure 4:
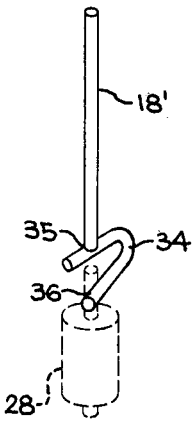
FIG. 4 shows a variant of the lead and electrode assembly.

FIG. 4 illustrates a variant of the lead and electrode assembly wherein the inner portion of the niobium inlead 18' is cut off at a point corresponding to emergence from the aperture through the ceramic plug. A small U-shaped connector piece 34, preferably of niobium, is welded at 35 to the distal end of the inlead to form a cross support or hanger. The upper leg of connector 34 then serves to support the ceramic plug prior to and during sealing, and the electrode shank is welded at 36 to the lower leg.

The crosspiece 33 may also provide a convenient means for locking reflector band 27 in place. As illustrated in FIG. 2, a bent-over tab 37 prevents the band from sliding down the arc tube while the ends of the crosspiece overreach the band and prevent it from sliding off the end of the arc tube.

What I claim as new and desire to secure by Letters Patent of the United States is:

1. A high pressure vapor discharge lamp comprising:

a tubular light-transmitting ceramic envelope having an end closures and thermionic electrodes sealed into its ends and containing an ionizable filling;

a closure assembly at one end of said envelope comprising a ceramic plug having a perforation and a ceramic-matching metal inlead conductor sealed therethrough, said plug being sealed to said envelope and said inlead being sealed to said plug by sealing frit;

and a crosspiece attached to said inlead immediately next to the plug and extending transversely across the end of said envelope, and a ridge of sealing frit on the surface of said plug reaching up to said crosspiece and extending from the inlead-plug seal at the perforation to the plug-envelope seal on each side.

2. A lamp as in claim 1 wherein said crosspiece is a fine welded to said inlead immediately above said plug and overreaching the envelope walls in order to serve as a hanger to support said closure in the envelope end during sealing.

3. A lamp as in claim 2 wherein said crosspiece is bent on a plane transverse to said inlead sufficiently to engage the envelope walls on a diameter whereby the closure assembly will hang vertically in the envelope during sealing.

4. A lamp as in claim 2 including a metal reflector band around said one end of the envelope, said crosspiece having its ends overreaching said band whereby to prevent the band from sliding off the end of the envelope.

5. A lamp as in claim 1 wherein said ceramic is alumina and said inlead is of niobium.

6. A lamp as in claim 4 wherein said ceramic is alumina and said inlead is a solid niobium wire.

* * * * *